United States Patent [19]

Muller

[11] Patent Number: 4,850,648

[45] Date of Patent: Jul. 25, 1989

[54] GEAR RACK FOR DRIVING OR GUIDING A DRUM CUTTER LOADER

[75] Inventor: Lothar Muller, Bochum, Fed. Rep. of Germany

[73] Assignee: Gebr. Eickhoff Maschinenfabrik u. EisengieBerei mbH, Bochum, Fed. Rep. of Germany

[21] Appl. No.: 255,339

[22] Filed: Oct. 11, 1988

[30] Foreign Application Priority Data

Oct. 28, 1987 [DE] Fed. Rep. of Germany ..... 3736485

[51] Int. Cl.[4] ..... E21C 29/02; E21C 35/12

[52] U.S. Cl. ..... 299/43; 105/29.1

[58] Field of Search ..... 299/29, 34, 42, 43; 105/29.1

[56] References Cited

U.S. PATENT DOCUMENTS

| | | | |
|---|---|---|---|
| 4,397,199 | 8/1983 | Jahn | 105/29.1 R |
| 4,773,710 | 9/1988 | Klimeck et al. | 299/43 |

FOREIGN PATENT DOCUMENTS

| | | | |
|---|---|---|---|
| 3623387 | 1/1988 | Fed. Rep. of Germany | 299/43 |
| 992737 | 1/1983 | U.S.S.R. | 299/43 |
| 1562527 | 3/1980 | United Kingdom | 299/43 |

*Primary Examiner*—Stephen J. Novosad
*Assistant Examiner*—David J. Bagnell
*Attorney, Agent, or Firm*—Clifford A. Poff

[57] ABSTRACT

A gear rack is made up of rack segments arranged end-to-end supported by and extending along face conveyor for meshing engagement with a gear of a drive to propel a mining machine along a mine face. The teeth of each rack segment extend between longitudinal cheek sections. A thicker one of the cheek sections has a downward extending shoulder at each of opposite ends to engage in a cavity of a bracket and secured therein for limited movement by a fastener pin. A wall section of the bracket extends against a bearing surface formed by a cavity in the underside of the gear tooth at the end portion of the rack segment. The width of the wall section corresponds to the width of the bearing surface.

8 Claims, 2 Drawing Sheets

1
1a
2
3
3a
4
6
7
8
9
10
11
12
13
14
15
A
B 1
1a
2
3
4
10

GEAR RACK FOR DRIVING OR GUIDING A DRUM CUTTER LOADER

BACKGROUND OF THE INVENTION

1. Field of the Invention: This invention relates to mining machinery for underground mining operations and more particularly, to drum cutter mining machines having a drive gear wheel meshing with uniformly spaced horizontal teeth extending between two spaced apart cheek plates forming a gear rack, a plurality of which extends along the course of travel of the mining machine with adjacent racks having shoulders engaged in a cavity of a mounting bracket while a bracket wall section engages in a cavity formed in an underside of a tooth of the gear rack.

2. Description of the Prior Art: A gear rack made up of individual rack segments for advancing movement of a drum cutter mining machines along a mine face are well known in the art. West German Patent Application No. P 36 24 109.1 discloses such a gear rack of which the individual rack segments have shoulders below the rack teeth to engage in the cavity of a mounting bracket. Connecting bolts extending at right angles to the elongated length of the gear rack secure adjacent rack segments to one bracket. The bracket is in turn secured to a longwall face conveyor situated below the gear rack to support the rack.

The purpose of such an arrangement for supporting a gear rack is to better absorb the tilting forces caused by the drum cutting machine when it is moving along the gear rack. Such forces are induced by unilateral mounting of rack segments which is intended to prevent deformations of the bracket wall. For reasons of manufacture, but even more so for reasons of assembly, the shoulders of the rack segments each extend a distance approximately corresponding to the pitch of the rack teeth. The shoulder engages in the cavity of the mounting bracket in a way to allow lateral movement of the shoulder in the cavity of the bracket. Consequently, the gear rack segments adjacent to each other can move horizontally and abut against each other because of such limited lateral movement. When the drive gear of the drum cutter-loader passes from one rack segment to the adjacent rack segment, the transition is made more difficult because the tooth width of the drive gear is large due to the tooth load caused by the high feed force needed to move the mining machine. The width of the gear teeth present operational difficulties as the gear teeth pass between the two cheek sections at opposite sides of the rack segment. A gap between sides of the gear teeth and the cheek sections of the rack segment is, however, necessary in order to accommodate lateral misalignment between rack segments when the longwall conveyor is advanced toward the mine face. Collisions between the rack segments and drive gear at the crossing points between rack segments due occur from time-to-time under these circumstances. Such collisions impair the travelling motion of the cutter-loader, but, above all, they increase wear, not only in the area of the drive gear teeth but also on the rack segments themselves.

For this reason, it has already been disclosed in West German Patent Application No. P 36 23 387, that the rack segments be equipped on the side turned away from the longwall conveyor with a ledge-like foot which produces either a rigid or a limited longitudinally movable communication between the rack segment and side bracket on the conveyor. At the front, the foot and the rack segments have shoulders or cavities corresponding to each other and engage with each other at the joint. Thus, vertical or horizontal movements of the rack segments relative to each other is prevented, but the longitudinal movement of the rack segments against each other is still possible.

SUMMARY OF THE INVENTION

According to the present invention, there is provided a gear rack assembly adapted to extend along a conveyor for engagement with drive gear of a mining machine to propel the mining machine along a mine face, the gear rack assembly including a plurality of gear rack sections each having horizontal teeth uniformly spaced apart and extending between longitudinal cheek sections. A bracket having a wall section rests against a surface of a cavity formed on the underside of a gear tooth, the bracket wall section having a width corresponding substantially to the width of the surface of the cavity in contact therewith. The bracket wall section is situated inside the cavity with clearances that will permit only a very small lateral relative displacement so as to eliminate the possibility that the ends of adjacent gear rack segments can shift horizontally against each other. In this way, one of the main causes of great wear on rack assemblies and drive gears meshing therewith is removed. Moreover, the present invention permits and exchange of older designs of rack segments for rack segments constructed according to the present invention. The present invention further maintains the capability of rack sections to undergo horizontal angling movements relative to each other because a cavity in the wall bracket maintains the capability for such relative movement of the rack sections of the order of magnitude which is required.

In the preferred aspect of the present invention, the rack teeth have a cross section approximately corresponding to a trapezoid in which the tooth surfaces taper upwardly and toward each other so that both lateral surfaces of the tooth are involute in the vertical and concave or convex in the horizontal. Such a cross-sectional configuration of the rack teeth provides that when the tooth at the opposite ends of a rack segment is provided with the cavity to rest against a bracket section having a relatively wide abutment surface. The present invention also improves meshing engagement between teeth of the drive gear and rack teeth of the rack segments by providing that the rack gear drive teeth engage centrally with the rack teeth through the provision of an abutment surface which avoid sliding movement between surfaces resting against one another and with corresponding convex or concave design of the tooth profiles for the drive gear. The abutment surface centering the drive gear at the middle of the rack gear teeth.

It is advantageous to provide, according to the present invention, that the opposite inner surfaces of the two cheek sections of a gear rack segment diverge upwardly and curve in an arch-like manner starting, for example, from central axis of a rack gear tooth or profile reference line of the gear teeth. Whenever the rotational axis of the drive gear of the drum cutter loader is not situated at right angles to the longitudinal direction of the gear rack segment and there is danger that the teeth of the drive gear may run against one of the two cheek sections, the curved inner surfaces of the cheek sections point or direct the drive gear tooth towards the center of the rack teeth and prevent collision between the drive gear and the gear rack segment.

It is further advantageous, according to the present invention to provide that opposite inner surfaces of the cheek sections of a rack segment form a segment of a circle which extends over the entire length of a rack segment and the center of a circle is in a common cross sectional plane running through the longitudinal center of a rack section. The center of the circle should be arranged to provide that the surfaces of the cheek sections inside the rack section diverge towards the end of the rack section. In this way, the area of inter-space between opposed cheek sections increases to a maximum at the junction of a rack segment with an adjacent rack segment. The area of the inter-space constantly decreased therefrom to the longitudinal center of a rack section. In curved areas of the gear rack section, for example, when the longwall conveyor is advanced towards a mine face, the drive gear of the cutter loader has adequate space to operate between the two cheek sections even though the drive gear may assume a tilted position in relation to the longitudinal direction of the rack segment. Also, when the teeth of the drive gear project over the profile reference line of the teeth of the gear rack, the drive gear teeth are not impeded when running along the gear rack because the surfaces by which the rack teeth are supported along the bracket are no greater than the diameter of the rack teeth or the width of the tooth base (dedendum).

It is recommended according to the present invention that the gear rack sections be produced without shaving or chipping operations in the form of a casting, for example, or, pressed or forced into a cavity of a die block.

DESCRIPTION OF THE DRAWINGS

These features and advantages of the present invention as well as others will be more fully understood when the following description is read in light of the accompanying drawings in which.

DETAILED DESCRIPTION OF THE DRAWINGS

Before describing the details of the construction of the gear rack and its support structure according to the present invention, it is well known in the art and incorporated herein by reference thereto to provide a gear rack made up a plurality of rack segments arranged end-to-end for propelling a mining machine along a mine face as shown in U.S. Pat. Nos. 4,082,361, and 4,155,660. The rack is mounted at the side wall of a face conveyor or spill plate for both supporting and moving a mining machine, particularly a drum cutter type mining machine, along the conveyor. A drive on the mining machine, conventionally referred to as a winch, has a drive output shaft onto which gears are mounted for propelling the mining machine along the rack through meshing engagement with the rack gear teeth. The drive gear of the mining machine engages rack teeth of successively arranged rack segments during transversing movement along the conveyor in either direction, which movement is accompanied by operation of drum cutters to release coal from the mine face confronted by the drum cutters.

Figure 1:
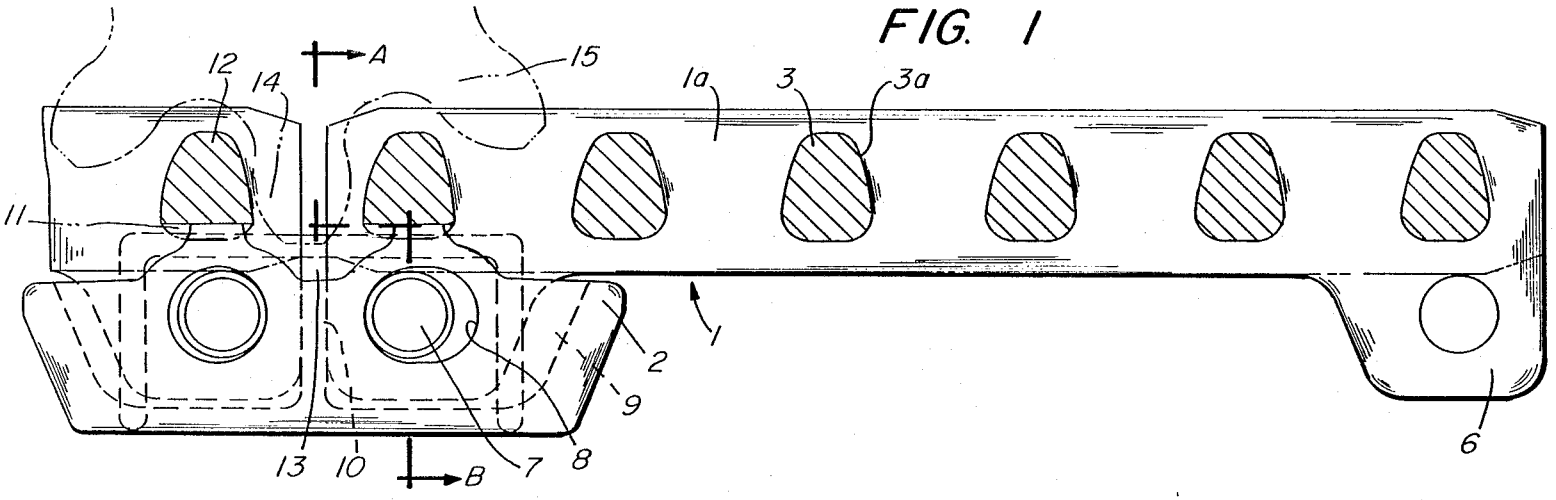
FIG. 1 is an elevational view in section through the central portion of a gear rack segment.
Figure 3:
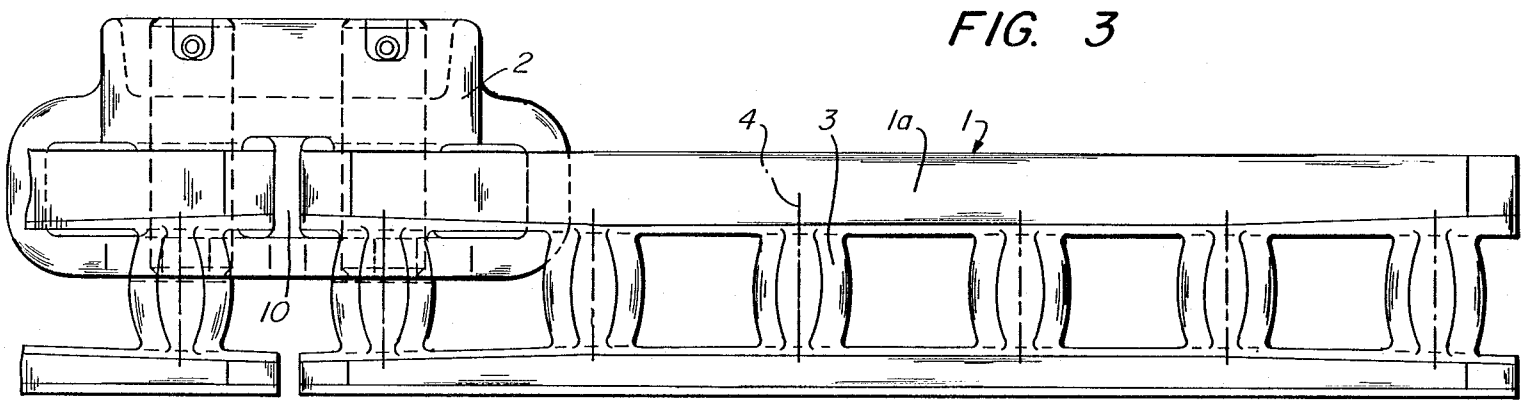
FIG. 3 is a plan view of rack segment of FIG. 1.

As shown in FIGS. 1 and 3, the gear rack 1 arrangement for a mining machine is made up of a plurality of gear rack segments 1*a* which are elongated and arranged in an end-to-end relationship to extend along a course of travel by a mining machine. A gear wheel of a drive gear on the mining machine, and particularly a drum cutter loader mining machine meshes with teeth of the rack segments. Each rack segment 1*a* includes an aligned row of spaced apart rack teeth 3, each having an axis 4 extending horizontally between two cheek sections 5 and 5*a* with respect to the direction of travel by the mining machine along a coal face. As can be seen from FIGS. 2 and 3, cheek section 5 has a relatively greater width as compared with cheek section 5*a*. Cheek section 5 defines the length of the rack section and is provided with a downwardly projecting shoulder or lug 6 at each of opposite ends of the cheek section. Each shoulder is provided with a bore into which there is received a fastener shaft 7 which has a longitudinal axis arranged in a parallel relation with the axis 4 of the rack teeth. The fastener shaft engages at both of its opposite ends in oblong holes 8 formed in walls 2*a* of a bracket 2. As can be seen from FIGS. 1 and 3, the walls 2*a* extend in a direction which is parallel to the direction which cheek section 5 extends. It is to be understood that the rack segment 1*a* bridges the junction of two conveyor pan sections and permits limited longitudinal movement of one pan section relative to the other as well as limited horizontal misalignment between the conveyor pan sections in relation to the gear rack segment. For this purpose the bracket 2 is provided with a cavity 9 having a width that is sufficiently greater than the thickness of shoulder 6 to accommodate the required relative movement between pan sections. A rib 10 extends upwardly in the cavity 9 between the two front faces of adjacent rack segments when the lugs thereof are positioned in the bracket 2. The rib 10 thus divides the cavity 9 forming two pockets while the rib serves to increase the rigidity of the bracket walls 2*a* thereby imparting the necessary strength the withstand loads which occur mainly when the longwall conveyor is advanced toward the mine face as well as when the cutter loader mining machine is traveling in a looped manner.

Figure 2:
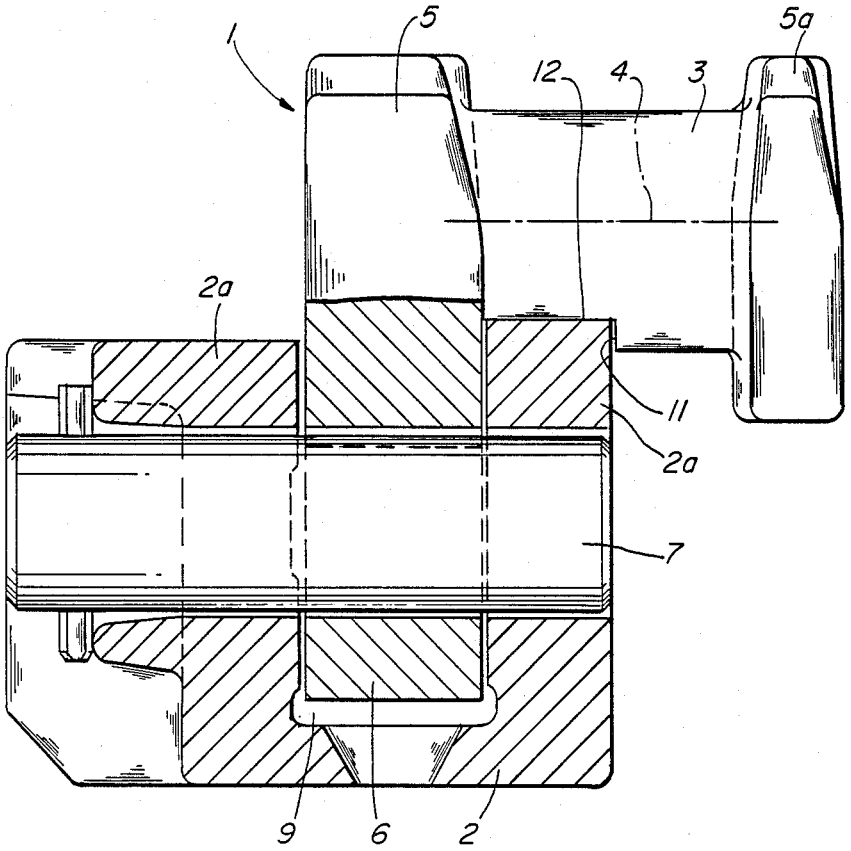
FIG. 2 is a sectional view taken along lines A-B of FIG. 1.

As can be seen from FIG. 1, the rack teeth 3 in the exemplified embodiment have a trapezoidal cross section. The tooth profile in cross section tapers upwardly along two lateral surfaces 3*a* which form an involute shape in a vertical. As can be seen from FIG. 3, the transverse tooth profile between the cheek sections is convexly shaped in the horizontal direction. The particular rack tooth which is at the end of the rack segment when positioned above the bracket is provided with a cavity 11 extending in the longitudinal direction of the rack segment. As best shown in FIGS. 1 and 2, a portion of the bracket wall 2*a* which underlies the rack segment is received in the cavity 11 and engages with a bearing surface 12 resulting from the formation of the cavity. The length of the bracket wall section which engages with bearing surface 12 does not exceed the transverse thickness of the fastener shaft which is beneath it. It can be seen from the arrangement illustrated in FIG. 1 that two bearing surfaces 12 are formed on the under side of the particular teeth that are at the end portions of consecutively arranged rack segments. A trough 13 is formed in the bracket wall 2*a* which spans the gap between the bearing surfaces 12 of the two adjacent rack pieces so that a particular tooth identified by reference numeral 14 of the drive gear wheel 15 can enter the trough 13 as the gear rotates during advancing movement from tooth to tooth. It can also be seen that the width of the bracket wall portion engaged with the bearing surface 12 is matched to the thickness of the bracket wall 2*a*. Because of this, the rack segment can move only a small distance in a direction which is parallel to the axis 4 of the gear teeth. But, at the same time there is no possibility of shifting movement in the horizontal direction in relation to an adjacent one of the rack segments. The shortness of the bearing surface 12 does not prevent the rack segment which bridges the junction between conveyor pans from moving slightly out of an aligned relation with an adjacent one of the rack segments which is necessary when a longwall conveyor is advanced in a direction laterally towards the mine face.

As illustrated in FIG. 2, the opposing inner surfaces of the two cheeks sections 5 and 5*a* are curved in an arch-like manner. The course of this curved configuration begins at approximately at a plane containing the various axes 4 of the rack teeth and proceeds from this plane in a manner to widen the inner space between the opposing cheek sections in a direction upwardly thereof and thereby procludes collisions between a tooth 14 of the driving gear wheel 15 and the surfaces of cheek sections 5 and 5*a*. The rack segment are preferably produced without shaving or chipping operations through casting procedures, for example, or pressed or forcing metal into a cavity of a die block. It is practical from a point of manufacturing operations to construct the inner surfaces of both cheek sections 5 and 5*a* in the form of a segment of a circle which extends over the entire length of one rack segment. The center point of the curvature form of a part of a circle, is situated in a transverse plane extending through the longitudinal center of a rack section facing in opposite directions. This configuration of a rack segment can be best seen from FIG. 3 in which it will be observed that when viewed in the plan view thereof, the inside surfaces of the cheek sections 5 and 5*a* which face each other diverge outwardly when proceeding from the mid-point of the rack segment to either of opposite ends of the rack segment.

While the present invention has been described in connection with the preferred embodiments of the various Figures, it is to be understood that other similar embodiments may be used or modifications and additions may be made to the described embodiment for performing the same functions of the present invention without deviating therefrom. Therefore, the present invention should not be limited to any single embodiment, but rather construed in breadth and scope in accordance with the recitation of the appended claims.

What is claimed is:

1. A gear rack forming part of the drive system for moving a mining machine along a conveyor, said gear rack including the combination of:

a plurality of rack segments each having spaced apart gear teeth extending between cheek sections at opposite sides of the rack segment, a gear tooth at each of opposite end portions of a rack segment having a cavity formed in the underside of the gear tooth, a cheek shoulder extending downward at each of the opposite ends of one of said cheek sections, a bracket including a bracket wall having a width corresponding to the width of said cavity for engaging and providing support for the rack segment, said bracket having a cavity for receiving cheek shoulders of rack segments when arranged at an end-to-end relation, fastener means extending generally parallel with the extended length of said rack teeth for securing and allowing limited movement of the cheek shoulders relative to the fastener means.

2. The gear rack according to claim 1 wherein said gear teeth have trapezoidally shaped cross sections arranged such that each tooth tapers upwardly along two lateral surfaces which are inviolate shaped in the vertical and curved in the horizontal.

3. The gear rack according to claim 2 wherein said lateral surfaces are convexly shaped in the horizontal.

4. The gear rack according to claim 2 wherein said lateral surfaces are concavely shaped in the horizontal.

5. A gear rack according to claim 1 wherein said cheek sections include surfaces facing each other at opposite sides of said gear teeth which surfaces diverge upwardly and curved in an arch shape from a plane passing through central axis of said gear teeth.

6. The gear rack according to claim 1 wherein said cheek sections have surfaces facing each other at opposite sides of said gear teeth, said surfaces forming a segment of a circle which extends horizontally over the length of the rack segment.

7. The gear rack according to claim 1 wherein said cheek sections have opposing face surfaces derived from a segment of a circle having a center point of curvature lying in a common cross-sectional plane which runs through the longitudinal center of a rack segment, said face surfaces of the cheek sections being arranged to diverge in a direction towards each of the opposite ends of the rack segment.

8. A gear rack accordingly to claim 1 wherein said rack segments are molded without the production of chips.

* * * * *